United States Patent [19]

Sumi et al.

[11] Patent Number: 4,941,326

[45] Date of Patent: Jul. 17, 1990

[54] AIR CONDITIONER HAVING OUTDOOR AIR INTRODUCING MECHANISM

[75] Inventors: Toyo Sumi; Motoshi Miyanaka, both of Shimizu; Keiji Sato, Shizuoka; Yoshiki Hayata, Shimizu, all of Japan

[73] Assignee: Hitachi, Ltd., Tokyo, Japan

[21] Appl. No.: 260,773

[22] Filed: Oct. 21, 1988

[30] Foreign Application Priority Data

Nov. 2, 1987 [JP] Japan ..... 62-275756

[51] Int. Cl.[5] ..... F25D 17/00

[52] U.S. Cl. ..... 62/180; 165/16; 236/49.3; 236/13

[58] Field of Search ..... 62/180, 186; 165/16; 236/49.3, 13

[56] References Cited

U.S. PATENT DOCUMENTS

| | | | |
|---|---|---|---|
| 2,284,764 | 6/1942 | Parks | 236/13 X |
| 2,290,985 | 7/1942 | McElgin | 236/13 X |
| 2,656,111 | 10/1953 | Lehane et al. | 236/13 X |
| 2,729,396 | 1/1956 | Impey et al. | 236/13 X |
| 2,813,235 | 11/1957 | Clay | 236/13 X |
| 4,244,193 | 1/1981 | Haakenson | 62/180 |
| 4,323,111 | 4/1982 | Iijima | 62/180 X |
| 4,379,484 | 4/1983 | Lom et al. | 62/180 X |
| 4,404,815 | 9/1983 | Gilson | 62/180 |
| 4,667,480 | 5/1987 | Bessler | 62/180 |

*Primary Examiner*—Harry B. Tanner

*Attorney, Agent, or Firm*—Antonelli, Terry, Stout & Kraus

[57] ABSTRACT

An air conditioner in which an outdoor unit having a compressor, a condenser, and expansion valve and an outdoor fan and an indoor unit having an evaporator and an indoor fan are connected by a piping to form a refrigerating cycle, and which has an outdoor air introducing mechanism including a damper disposed in an air flow path of the indoor fan of the indoor unit so as to enable introduction of outdoor air into the room. The air conditioner has: a comparison means for periodically comparing the room temperature with a room temperature set point; an alteration means for altering, on the basis of the output from the comparison means, a mixed air temperature initial set point preliminarily determined; and a control means for controlling the operations of the outdoor air introduction damper, the outdoor and indoor fans and the compressor.

2 Claims, 6 Drawing Sheets

AIR CONDITIONER HAVING OUTDOOR AIR INTRODUCING MECHANISM

BACKGROUND OF THE INVENTION

This invention relates to an air conditioner having an outdoor air introducing mechanism and, more particularly, to a control system suitable for optimizing the ability to cool outdoor air in response to changes in the cooling load and/or the ventilation rate.

In a conventional system of controlling an air conditioner, an outdoor air introduction damper is driven in such a manner that, during the ON state of a cooling thermostat serving as a room temperature sensor, the temperature of an air consisting of room return air and outdoor air mixed with each other becomes equal to a set point of a mixed air thermostat the set point of which can be changed only by a manual operation and that, during the OFF state of the cooling thermostat, the opening of the outdoor air introduction damper is set to the minimum opening.

U.S. Pat. No. 4,244,193 discloses an example of a type of cooling system utilizing outdoor air. This system utilizes, in order to reduce energy consumption of the cooling system, outdoor air by employing an auxiliary unit having a simple structure and capable of being easily mounted.

This type of auxiliary unit is used in combination with a mechanical cooling system so as to assist this cooling system in cooling a room by utilizing outdoor air.

To first reduce the temperature of air in the room to an intermediate temperature, a mechanical cooling system or a combination of a mechanical cooling system and an auxiliary unit is utilized.

The room is cooled at a predetermined low temperature while an outdoor air temperature reaction fan for introducing outdoor air having a comparatively low temperature into the room when the room temperature is lower than a predetermined temperature is operated.

This type of conventional system has been designed to set the mixed air temperature by a manual change-over operation without any consideration for means to optimize the setting of the mixed air temperature in response to variations in the cooling load and the ventilation rate. It the cooling load exceeds a level assumed at the time of the initial setting of the mixed air temperature, the cooling power becomes inadequate to maintain the desired low temperature and, if the ventilation rate becomes lower than the set rate, the cooling power also becomes inadequate and the user have to reset the mixed air temperature to a lower value. Conversely, if the cooling load becomes lower than the initial setting level or if the ventilation rate becomes higher, the cooling power becomes excessively large and the cooling thermostat is switched off. At this time, however, the opening of the outdoor air introduction damper is reduced to the minimum, and air is supplied to the interior of the room at a temperature substantially equal to the room return air temperature, resulting in an increase in the variation of the supplied air temperature.

SUMMARY OF THE INVENTION

It is therefore an object of the present invention to provide an air conditioner capable of automatically setting the mixed air temperature instead of manual operation of the user while optimizing this temperature relative to changes in the cooling load and/or the ventilation rate, the air conditioner being also capable of minimizing an abrupt increase in the temperature of supplied air at the time of switching-off of the cooling thermostat.

To this end, the present invention provides an air conditioner in which an outdoor unit having a compressor, a condenser, and expansion valve and an outdoor fan and an indoor unit having an evaporator and an indoor fan are connected by a piping to form a refrigerating cycle, and which has an outdoor air introducing mechanism including a damper disposed in an air flow path of the indoor fan of the indoor unit so as to enable introduction of outdoor air into the room, the air conditioner including: a comparison means for periodically comparing the room temperature with a room temperature set point; an alteration means for altering, on the basis of the output from the comparison means, a mixed air temperature initial set point preliminarily determined; and a control means for controlling the operations of the outdoor air introduction damper, the outdoor and indoor fans and the compressor. The set point of the room temperature sensor thermostat is compared with the actual room air temperature certain time after the outdoor air cooling operation has been started, and the mixed air temperature set point is altered on the basis of the result of this comparison in such a manner that the mixed air temperature initial set point is increased if, as a result of the comparison, the room temperature set point is higher than the actual temperature, is reduced if the room temperature set point is lower than the actual temperature, or constantly maintained if the room temperature set point falls into an intermediate range. On the basis of this setting, the outdoor air introduction damper is driven such that the mixed air temperature coincides with the altered mixed air temperature set point. This process is repeated at certain time intervals. Preferably, the sampling time of the above comparison is set to be shorter during the OFF state of the cooling thermostat than during other states.

DESCRIPTION OF THE PREFERRED EMBODIMENTS

Figure 1:
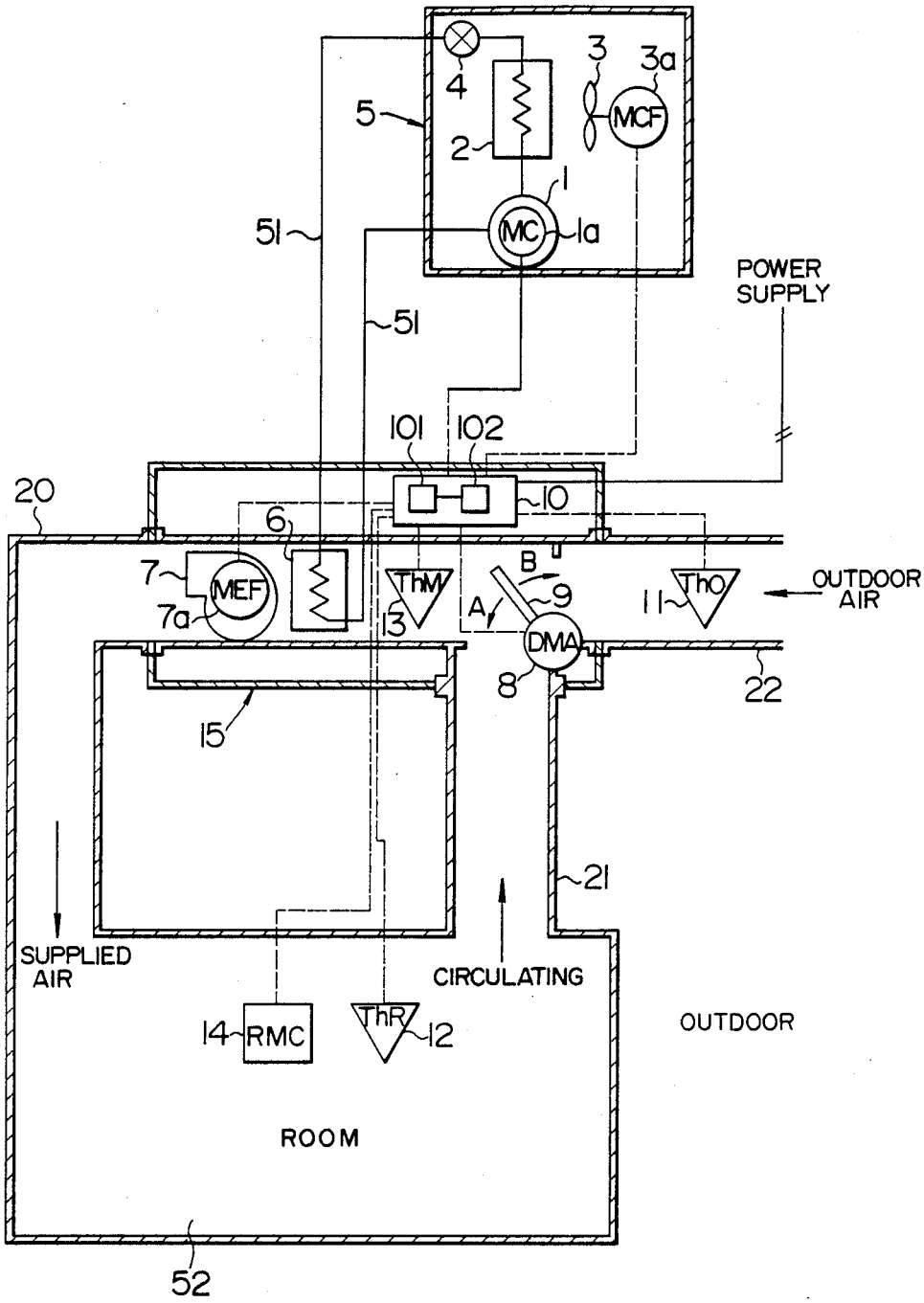
FIG. 1 is a diagram of the entire system of an embodiment of the present invention.

An embodiment of the present invention will be described below with reference to FIG. 1 to 5. FIG. 1 shows the whole system of an air-cooled and split type of air conditioner to which the present invention is applied. An outdoor unit 5 which is constituted by a compressor (MC) 1 connected between a piping 51 to form a refrigerating cycle, a condenser 2, an outdoor fan 3, an outdoor ventilator motor (MFC) 3*a*, and a decompression mechanism 4 inserted in the refrigerating cycle is disposed on the outside of a room 52 to be cooled. An indoor unit 15 is connected to a supply duct 20 through which air is ejected to the interior of the room, a return duct 21 through which air is returned from the interior of the room, and an outdoor air duct 22 through which outside air is introduced into the room. The indoor unit 15 is constituted by an evaporator 6 inserted in the refrigerating cycle, an indoor fan 7, a multispeed indoor fan motor (MEF) 7a, a damper driving device (DMA) 8 and a damper 9 disposed at the intersection between the return duct 21 and the outdoor air duct 22, and a controller 10 connected to a power source. An outdoor air temperature sensor ($Th_O$) 11 mounted inside an outdoor air duct 22, a room temperature sensor ($Th_R$) 12 mounted inside the room 52, a mixed air temperature sensor ($Th_M$) 13 mounted between the damper 9 and the suction side of the evaporator 6, and a remote control panel (RMC) 14 disposed in the room 52 are respectively connected to the controller 10 via signal lines.

The controller 10 includes a control section for controlling the compressor, the fans and the damper, a comparison means 101 for periodically comparing the room temperature with the room temperature set point, and an alteration means 102 for changing, on the basis of the output from the comparison means, the initial set point of the mixed air temperature preliminarily determined.

If the damper driving device (DMA) 8 rotates in the normal direction, the damper 9 rotates in a direction of the arrow A so that the rate at which outdoor air is introduced into the room is increased while the rate at which air is returned form the room is reduced. If the damper driving device 8 rotates in a reverse direction, the damper 9 rotates in a direction of the arrow B and the rate at which outdoor air is introduced into the room is reduced while the rate at which air is returned form the room is thereby increased.

Figure 2:
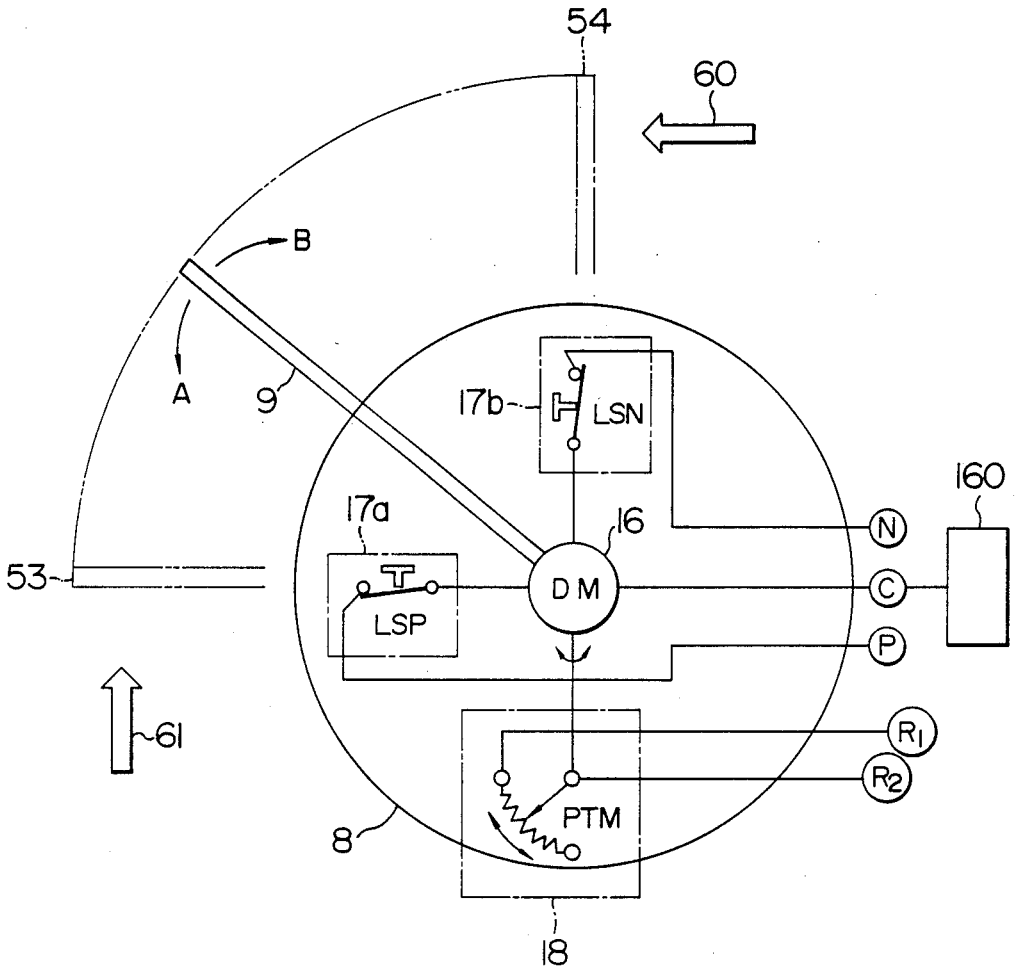
FIG. 2 is a diagram of details of a damper driving device.

As shown in FIG. 2, the damper driving device (DMA) 8 has a full-opening limit switch ($LS_p$) 17a which is opened when the damper 9 fully opens the path through which outdoor air 60 is introduced, that is, the damper 9 is moved to a position 53 at which the rate at which room return air 61 flows becomes naught, and a complete-closing limit switch ($LS_N$) 17b which is opened when the damper 9 completely closes the path through which outside air is introduced, that is, the damper 9 is moved to a position 54 at which the outdoor air introduction flow rate relative to the room return flow rate becomes naught. These limit switches are connected to the controller 10. A potentiometer (PTM) 18 is connected to the damper motor (MD) 16 so that it is moved in a linked relationship with the rotation of the damper motor 16, and that the resistance of the potentiometer changes in response to this rotation. The damper motor (MD) 16 is a reversible motor which rotates in the normal direction (as indicated by the arrow A) when a voltage is applied to this motor between a pair of terminals P and C connected to a power source 160, it rotates in the reverse direction (as indicated by the arrow B) when a voltage is applied between a pair of terminals N and C, or it does not rotate when no voltage is applied to any one of these pairs of terminals. A pair of terminals R1 and R2 are used to detect the resistance of the potentiometer (PTM) 18. In response to one of resistance values thereby detected, the minimum opening of the damper is determined by microcomputer processing.

Figure 3:
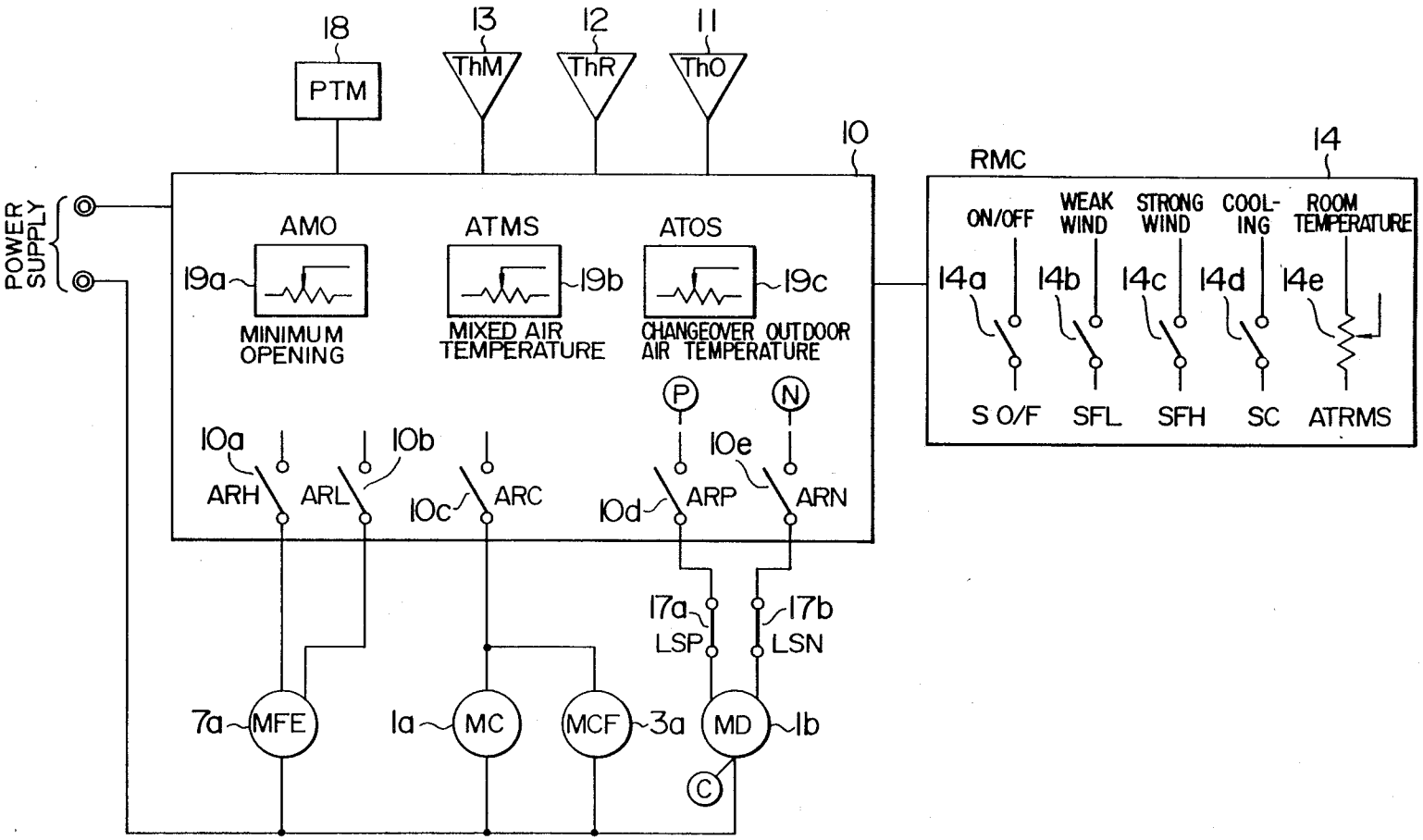
FIG. 3 is an operation block diagram of the embodiment shown in FIG. 1.

FIG. 3 shows a schematic circuit diagram relating to overall control of this air conditioner.

The controller 10 has connections to other components such that it is supplied with signals output from the remote control panel (RMC) 14 and representing the states of setting of a rotary switch 14a, a weak wind switch (SFL) 14b, a strong wind switch (SFH) 14c, a cooling switch (SC) 14d, and a room temperature setting device (ATRMS) 14e, signals representing sensed values output from the outdoor temperature sensor ($Th_O$) 11, the room temperature sensor ($Th_R$) 12, the mixed air temperature sensor ($Th_M$) 13, and the potentiometer (PTM) 18, and signals representing the states of setting of a damper minimum opening setting device ($A_{MO}$) 19a, a mixed air temperature setting device ($A_{TMS}$) 19b, and an outdoor-air-cooling-changeover outdoor air temperature setting device ($A_{TOS}$) 19c, and that it performs comparison/calculation processings from these signals and outputs the results of these operations.

A relay ($AR_H$) 10a for a strong-wind operation of the indoor fan motor and a relay ($AR_L$) 10b for a weak-wind operation of the indoor fan motor supply contact are connected in parallel with each other to the multispeed indoor fan motor (MEF) 7a, a compressor relay ($AR_C$ 10c is connected to the compressor (MC) 1a and the outdoor fan motor (MCF) 3a so that it can simultaneously drive these motors, and a relay ($AR_P$) 10d for the normal rotation of the damper and a relay ($AR_N$) 10e for the reverse rotation of the damper are connected to the damper motor (MD) 16. The operation of each motor is thereby controlled.

Figure 4:
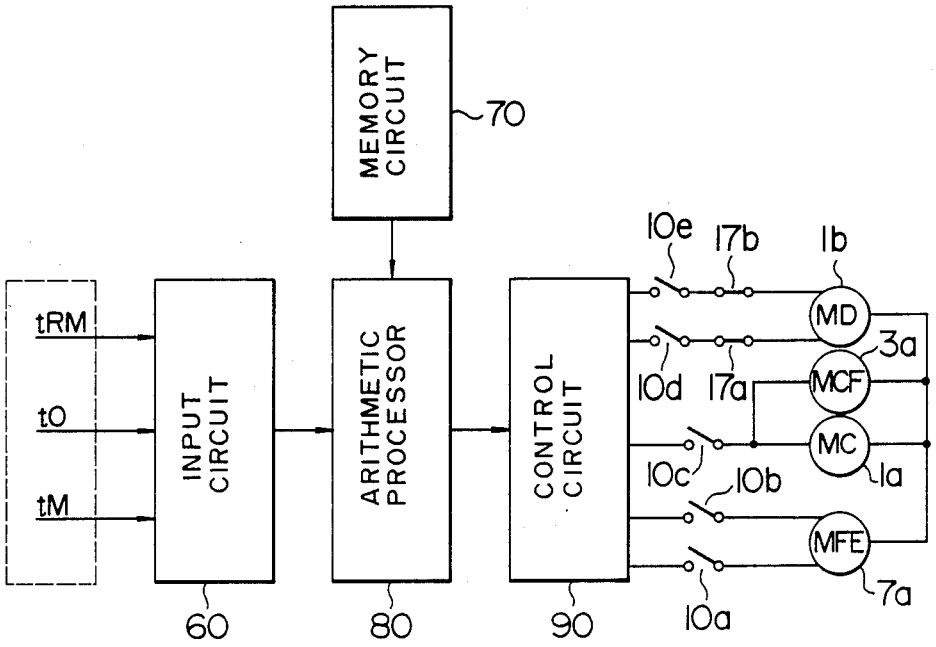
FIG. 4 is a block diagram of microcomputer control.

FIG. 4 shows a block diagram of a control device having a microcomputer for controlling this air conditioner. The control device has: an input circuit 60 through the room temperature $t_{RM}$, an outdoor air temperature $t_O$, and a mixed air temperature $t_M$; a memory circuit 70 for storing a room temperature set point $t_{RMS}$, a mixed air temperature initial set point $t_{MSS}$, an outdoor-air-cooling-changeover outdoor air temperature set point $t_{OS}$, and a damper minimum opening set point; an arithmetic processing section 80; and a control circuit 90. The arithmetic processing section 80 and the control circuit 90 operate to control the opening of the damper 9 and the operations of the compressor 1 and the outdoor and indoor fans 3 and 7 by comparing the room temperature $t_{RM}$ with the room temperature set point $t_{RMS}$, the outdoor air temperature $t_O$ with the outdoor-air-cooling-changeover outdoor air temperature set point $t_{OS}$, and the mixed air temperature $t_M$ with the mixed air temperature initial set point $t_{MSS}$. The arithmetic processing section 80 and the control circuit 90 control the operation of opening or closing the damper 9 by using an altered mixed air temperature set point $t_{MS}$ or a renewed value of the mixed air temperature initial set point $t_{MSS}$ higher than the original value by $\Delta t_1$ (about 1° C.) if a state in which the room temperature $t_{RM}$ is lower than the room temperature set point $t_{RMS}$ has continued for a period of time $\tau_2$ (about one minute), and by using another renewed set point obtained by reducing the altered mixed air temperature set point $t_{MS}$ by $\Delta t_2$ (about 1° C.) if a state in which the room temperature $t_{RM}$ is higher than the room temperature set point $t_{RMS}$ has continued for a period of time $\tau_3$ (about three minutes).

Next, the operation of the air conditioner will be described with reference to Table 1, but the essentials of the present invention are as described below. The room temperature ($t_{RM}$) and the room temperature set point ($t_{RMS}$) are periodically compared with each other by the comparison means, and the alteration means alters the mixed air temperature set point by increasing the mixed air temperature initial set point ($t_{MSS}$) by $\Delta t_1$ (about 1° C.). If the operation has continued for a substantially long time under the condition that $t_{RM} \geqq t_{RMS} + \alpha 1$ (non-sensible temperature variation), the altered set point ($t_{MS}$) is changed again such that it is reduced by $\Delta t_2$ (about 1° C.). The drive control of the outdoor air introduction damper, the outdoor fan, the indoor fan and the compressor is thereafter continued by the control means on the basis of the room temperature set point altered in the above-described manner.

If the mixed air temperature set point is set to a lower value, the outdoor air introduction damper allows low-temperature outdoor air to be mixed with the room return air at a higher rate so that the mixed air temperature is reduced, thereby increasing the cooling power. In the case of reverse setting, the outdoor air introduction damper makes low-temperature outdoor air mixed with the room return air at a lower rate so that the mixed air temperature is increased, thereby reducing the cooling power. It is thereby possible for the air conditioner to follow up, without any malfunction, an optimum change in the setting of the mixed air temperature in response to a change in the cooling load as well as a fluctuation of the ventilation rate.

TABLE 1

| Operation modes | States of operation switch $S_{O/F}$ | SFL SFH | $S_C$ | Comparison between outdoor air temperature and outdoor air cooling change-over temperature | Comparison between room temperature and set room temperature |
|---|---|---|---|---|---|
| Stop | OFF | — | — | — | — |
| Ventilation | ON | SFH: ON | OFF | — | — |
| Cooling | ON | SFH: ON | ON | $t_O \geqq t_{OS}$ | $t_{RM} < t_{RMS}$ (Cooling thermostat OFF) |
| | | | | | $t_{RM} \geqq t_{RMS}$ (Cooling thermostat ON) |
| | | | | $t_{OS} > t_O$ (Outdoor air cooling range) | $t_{RMS} + \alpha 1 > t_{RM} \geqq t_{RMS}$ |
| | | | | | $t_{RM} < t_{RMS}$ (Cooling thermostat OFF) |
| | | SFL: ON | ON | | $t_{RMS} \geqq t_{RMS} + \alpha 1$ |
| | | | | | $t_{RM} \geqq t_{RMS} + \alpha 2$ ($\alpha 1 < \alpha 2$) |

Mixed air temperature setting

| Setting change condition | Set point after setting change |
|---|---|
| — | (Initial point $t_{MSS}$) |
| — | ($t_{MSS}$) |
| — | ($t_{MSS}$) |
| — | ($t_{MSS}$) |
| — | $t_{MSS}$ |
| Cooling thermostat OFF | $t_{MSS} + \Delta t_1$ |
| In the case where the cooling thermostat is still OFF time $\tau_2$ after changing into the OFF state | $t_{MS} + \Delta t_1$ |
| In the case where $t_{RM} > t_{RMS} + \alpha 2$ continues for time $\tau_3$ or more | $t_{MS} - \Delta t_2$ |

TABLE 1-continued

| | |
|---|---|
| In the case where this relationship continues for another $\tau_3$ min. | $t_{MS} - \Delta t_2$ |
| In the case where this state continues for $\tau_3$ min. even during the fully opened state of the damper | $t_{MS} - \Delta t_s$ |

Damper relay operation and damper opening

| ARP | ARN | Direction of damper operation | Final damper opening |
|---|---|---|---|
| OFF | ON → OFF | Closing | Completely closed |
| ON → OFF | OFF | Opening | Minimum opening |
| OFF | OFF | Stop | Minimum opening |
| OFF | OFF | Stop | Minimum opening |
| ON → OFF | OFF → ON | Opening Closing | Adjust |
| OFF | ON → OFF | Closing | Adjust |
| OFF | ON → OFF | Opening | Adjust |
| ON → OFF | OFF | Opening | Adjust |
| ON → OFF | OFF | Opening | Adjust |
| OFF | OFF | Stop | Fully opened |

| Stages of refrigerating-cycle motor operation MFE | | Explanation No. |
|---|---|---|
| OFF | OFF | 1 |
| ON | OFF | 2 |
| ON | OFF | 3 |
| ON | ON | 4 |
| ON | OFF | 5 |
| ON | OFF | 6 |
| ON | OFF | 7 |
| ON | OFF | 8 |
| ON | OFF | 9 |
| ON | ON | 10 |

$t_O$ Outdoor air temperature
$t_{RM}$ Room temperature
$t_{MSS}$ Mixed air temperature initial set point
$t_{OS}$ Outdoor-air-cooling-change-over Outdoor air set point
$t_{RMS}$ Room temperature set point
$t_{MS}$ Set point after mixed air temperature correction

EXPLANATION 1

If the operation start/stop switch ($S_{O/F}$) 14a of the remote control panel (RMC) 14 is turned off during the on state of the power source or during operation, the controller 10 switches on the damper reverse rotation relay ($AR_N$) 10e, and the damper motor (MD) 16 thereby rotates in the reverse direction until the complete-closing limit switch ($LS_N$) 17b is turned off, so that the damper 9 is completely closed to the outdoor air duct 22 and no outdoor air is introduced. All the other motors are turned off, and the operation is not started.

EXPLANATION 2

If the strong-wind switch ($S_{FH}$) 14c of the remote control panel (RMC) 14 is thereafter turned on, the controller 10 switches on the damper normal rotation relay ($AR_P$) 10d and thereafter switches off this relay so that the damper is stopped in an opened state when information on the angle of rotation calculated from a detected resistance value of the potentiometer (PTM) 18 coincides with the set point determined by the damper minimum opening setting device ($A_{MO}$) 19a. Correspondingly, the indoor fan 7 introduces outdoor air into the room at a rate required in the case of normal operation. In the case where the weak-wind switch ($S_{FL}$) 14b is turned on, the damper 9 is controlled in the same manner.

EXPLANATION ③

If the cooling switch (SC) 14d of the remote control panel (RMC) 14 is turned on when the outdoor air temperature $t_O$ is higher than the outdoor-air-cooling-changeover outdoor air temperature $t_{OS}$ set by the outdoor-air-cooling-changeover outdoor air temperature setting device ($A_{TOS}$) 19c, or if, when $t_O \geqq t_{OS}$ during cooling operation, the room temperature $t_{RM}$ is lower than the room temperature set point $t_{RMS}$ set by the room temperature setting device ($AT_{RMS}$) 14c, the air conditioner is operated in the same manner as Explanation ② the damper 9 is kept maintaining the minimum opening since the damper normal rotation relay ($AR_P$) 10d, the damper reverse rotation relay ($AR_N$) 10e, the compressor relay ($AR_C$) 10c are in the off state. In this state, therefore, there is no possibility of high-temperature outdoor air being introduced into the room at an excessively high rate and causing the room temperature to rise.

EXPLANATION ④

If the relationship between the room temperature $t_{RM}$ and the room temperature set point $t_{RMS}$ becomes $t_{RM} \geqq t_{RMS}$ under the same conditions as those in Explanation ③, the compressor relay ($AR_C$) 10c is switched on and the compressor motor ($M_C$) 1a and the indoor fan motor (MCF) 3a are thereby operated so that the system starts the cooling operation using the refrigerating cycle.

EXPLANATION ⑤

If the cooling switch ($S_C$) 14d is turned on when the relationship between the outdoor air temperature $t_O$ and the outdoor-air-cooling-changeover outdoor air temperature $t_{OS}$ is $t_O < t_{OS}$, and if the room temperature $t_{RM}$ is higher than the room temperature set point $t_{RMS}$ and does not exceed the non-sensible temperature variation (in which the mixed air temperature is not altered) $\alpha_1$, that is, $t_{RM}$ is lower than $t_{RMS}+\alpha_1$, the compressor relay ($AR_C$) 10c is switched off and the cooling operation using the refrigerating cycle is not performed. At this time, the damper normal rotation relay ($AR_P$) 10d is switched on, and the damper 9 rotates in the normal direction and is thereafter stopped when the damper normal rotation relay ($AR_P$) 10d is switched off at a position at which the temperature $t_M$ of air in which outdoor air and room return air are mixed becomes equal to the mixed air temperature initial set point $t_{MSS}$ set by the mixed air temperature setting device ($A_{TMS}$) 19b. As the outdoor air temperature $t_O$ changes in this case, the damper normal rotation relay ($AR_P$) 10d and the damper reverse rotation relay ($AR_N$) 10e are switched on or off so that the damper 9 is rotated in the normal or reverse direction, thereby adjusting the mixed air temperature $t_M$ to the mixed air temperature initial set point $t_{MSS}$ and performing outdoor-air-introducing cooling operation.

EXPLANATION ⑥

If, after the operation of Explanation ⑤, a state in which the relationship between the room temperature $t_{RM}$ and the room temperature set point $t_{RMS}$ is $t_{RM} \leqq t_{RMS}$ has continued for time $\tau_2$ (about one minute), that is, the cooling thermostat of the room temperature sensor is positively switched off, the controller 10 drives the damper 9 in such a manner that the damper 9 closes when the mixed air temperature becomes equal to the altered mixed air temperature set point $t_{MS}$ obtained by increasing the mixed air temperature initial set point $t_{MSS}$ by $\Delta t_1$ (about 1° C.), thereby preventing excessive cooling due to an excessive outdoor air introduction rate.

EXPLANATION ⑦

If the relationship between the room temperature $t_{RM}$ and the room temperature set point $t_{RMS}$ is still $t_{RM} \leqq TR_{MS}$ after another time $\tau_2$ (about one minute) has passed, an operation of forcibly making the altered mixed air temperature set point $t_{MS}$ $t_{MS}=t_{MS}+\Delta t_1$, thereby providing backup effect for the prevention of excessive cooling.

EXPLANATION ⑧

If, conversely relative to the case of Explanation ⑥, a state in which $t_{RM} > t_{RMS}+\alpha_1$, that is, the room temperature set point by a value of the non-sensible temperature variation $\alpha_1$, which tends to takes place when the total flow rate and the outdoor air introduction rate are reduced by, for example, turning on the weak wind switch ($SF_L$) 14b, has continued for time $\tau_3$ (about three minutes), and an operation of reducing the altered mixed air temperature set point $t_{MS}$ by $\Delta t_2$ (about 1° C.), that is, $t_{MS}=t_{MS}-\Delta t_2$ is performed, and the damper 9 is thereby adjusted to a larger opening so that mixed air of lower temperature is supplied to the interior of the room, thereby preventing lack of cooling power.

EXPLANATION ⑨

If the relationship between the room temperature $t_{RM}$ and the room temperature set point $t_{RMS}$ is still $t_{RM} > t_{RMS}+\alpha_1$ after another time $\tau_3$ (about three minute) has passed, the same operation as that of Explanation 8 is performed so as to further reduce the mixed air temperature set point in order to increase the cooling power.

EXPLANATION ⑩

If a state in which the mixed air temperature set point $t_{RM} \geqq t_{RMS}+\alpha_2$ ($\alpha_2 > \alpha_1$, $\alpha_2$ is a non-sensible temperature variation larger than $\alpha_1$) has continued for $\tau_3$ (about three minutes) even after the damper has been fully closed, the compressor relay ($AR_C$) 10c is switched on, and the outdoor fan motor (MCF) 3a are thereby turned on, so that the system starts to perform both the outdoor-air-introducing cooling operation and the refrigerating-cycle cooling operation.

Figure 5:
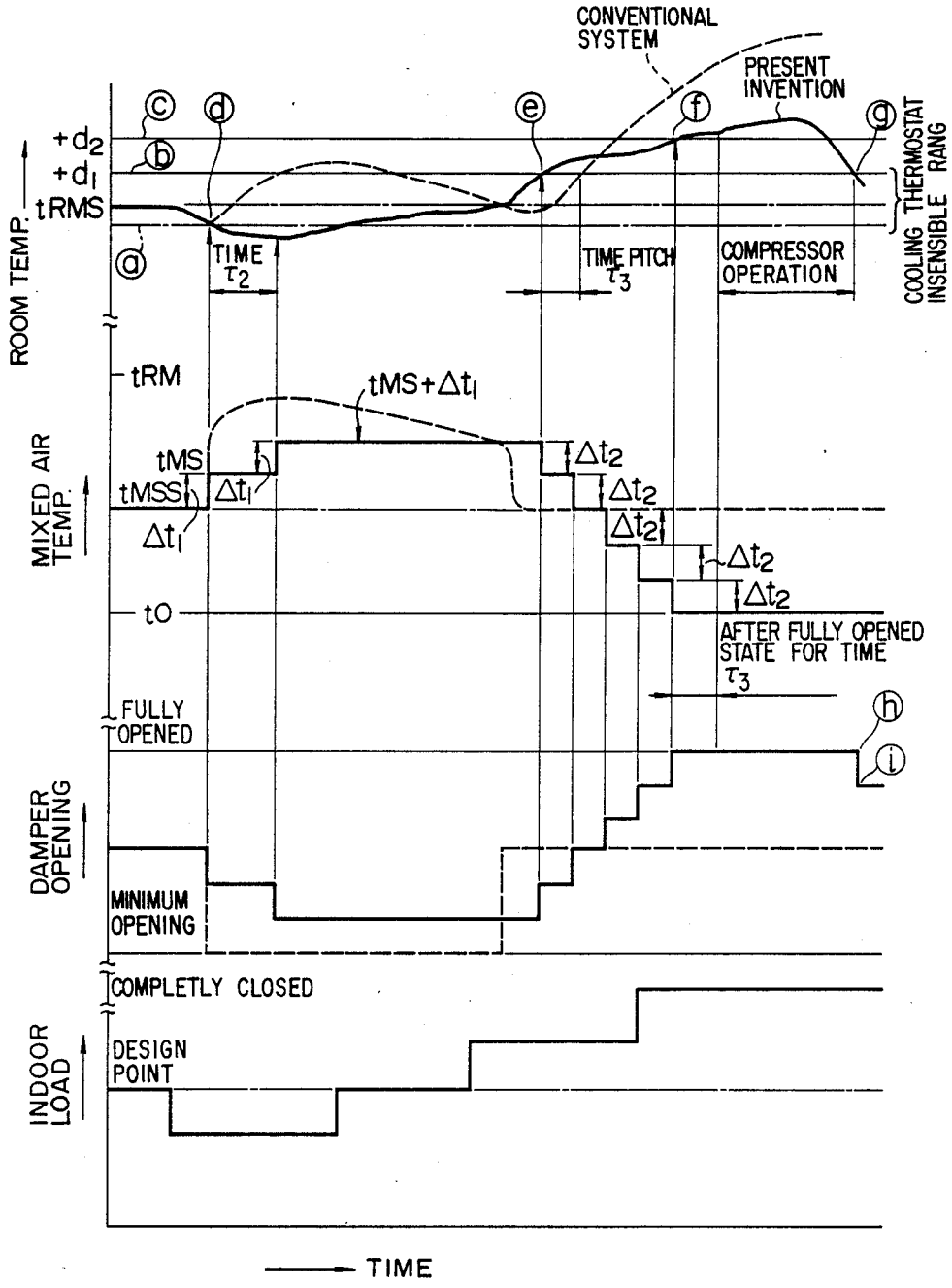
FIG. 5 is a graph of changes in the room interior load, the damper opening, the mixed air temperature and the room temperature in the systems based on the conventional technique and the present invention.

FIG. 5 shows a graph of changes in the room temperature, the mixed air temperature, the damper opening and the room interior load during operation, the broken lines indicating changes in the case of the conventional method, and the solid lines indicating estimated changes in the case of the present invention. In this graph, $t_{RMS}$ indicates a room temperature set point. On the basis of this set point, a chain line ⓐ indicates a level of −1° C., a solid line ⓑ level of $\alpha_1=1°$ C., and a solid line ⓒ level of $\alpha_2=3°$ C.

In the region below the chain line ⓐ, the mixed air temperature initial set point $t_{MSS}$ is altered by being increased (by $\Delta t_1$) Conversely, in the region above the solid line ⓑ, it is altered by being reduced (by $\Delta t_2$).

In the region between the chain line ⓐ and the solid line ⓑ a temperature difference of substantially 2° C., the mixed air temperature is not altered. This region is called a thermostat insensible region. At a point ⓓ, mixed air temperature initial set point $t_{MSS}$ is changed to set an altered mixed air temperature set point $t_{MS}$.

If the cooling thermostat is still off time $\tau_2$ (about one minute) after the time when the mixed air temperature initial set point is changed into $t_{MS}$, the mixed air temperature set point is increased by $\Delta t_1$ (about 1° C.), that is, changed into $t_{MS}+\Delta t_1$. Thereafter, the mixed air temperature set point is not changed before a point ⓔ. When the room temperature exceeds the level of the solid line ⓑ, the mixed air temperature set point is reduced by $\Delta t_2$ (about 1° C.).

The room temperature $t_{RM}$ is sampled at a time pitch of $\tau_3$ about three minutes) between the point ⓔ and a point ⓕ. If the condition is not changed, the mixed air temperature set point is further reduced by $\Delta t_2$ (about 1° C.) in a stepped manner.

When the room temperature reaches the point ⓕ, the damper is fully opened. After a state in which the room temperature is higher than $t_{RMS}+\alpha_2$, that is, it is above the solid line ⓒ has continued for time $\tau_3$, the operation of the compressor is started. At this time, both the refrigerating cycle cooling and the outdoor-air-introduction cooling operation are performed. When the room temperature reaches a point ⓖ in the cooling thermostat insensible region, the operation of the compressor is terminated, and only the outdoor air introduction cooling operation is performed. At this time, the damper opening is set to an opening point ⓘ lower than the full opening at a point ⓗ by one step.

The damper opening diagram shows that the opening is reduced when the room temperature becomes lower than the set point $t_{RMS}$, and that it is increased when the room temperature rises. In this damper opening diagram, a state in which the damper opening is reduced to the minimum opening is not indicated.

If, as a result of sampling from the point ⓓ for time $\tau_2$ (about one minute), the room temperature is below the chain line ⓐ, the damper opening is further reduced, possibly, to the minimum opening. The room interior load line is plotted on the basis of the design point, namely, the room temperature set point $t_{RMS}$ in proportion to the varying room temperature.

The essential features of the method of operating the air conditioner having the outdoor air introducing mechanism reside in that the room temperature sensor ($Th_R$) or cooling thermostat and the mixed air temperature initial setting device (ATMS) **19*b*** for maintaining, during operation, the room temperature $t_{RM}$ to a predetermined level are provided, and that, during the operation introducing outside air, the air conditioner is operated by using a altered mixed air temperature set point higher than the mixed air temperature initial set point by $\Delta t_1$ (about 1° C.) as long as the cooling thermostat is in the off state, and the air conditioner is operated by reducing the altered air temperature set point by $\Delta t_1$ (about 1° C.) if a state of operation in which the room temperature is higher than the room temperature set point continues.

In the above-described embodiment, the mixed air temperature set point is automatically optimized on the basis of the relationship between the room temperature and the room temperature set point $t_{RMS}$, thereby making it possible to eliminate a problem of lack of cooling power without requiring the user to manually operate the room temperature setting device (ATMS) **19*b*** when the air flow rate and/or the room interior load are changed. At the same time, it is possible to prevent frequent on/off operations when the cooling thermostat is in the off state during outside air introduction cooling.

Advantages of automatic control of the mixed air temperature without manual operations of the user are as follows.

(1) In the conventional method, there is a possibility of the cooling effect being inadequate unless the mixed air temperature is set to a lower level, that is unless the outdoor-air-cooling-changeover temperature is set to be lower. In accordance with the present invention, however, the set point can be automatically controlled, thereby preventing any considerable reduction in the cooling effect. In addition, the applicable outdoor air temperature range of the outdoor air introduction cooling operation is thereby widened so that the range of cooling operation using the refrigerating cycle is reduced, thereby enabling saving of electric power.

(2) The rate of abrupt increase in the temperature at the time of switching-off of the cooling thermostat during the outdoor air introduction cooling operation is reduced, thereby improving the cooling in terms of comfort.

(3) It is not necessary to perform, during trial run, try-and-error setting of suitable values of the altered mixed air temperature set point $t_{MS}$ and the outdoor-air-cooling-changeover outdoor air temperature set point $t_{OS}$, thereby simplifying the installation trial run operation.

Figure 6:
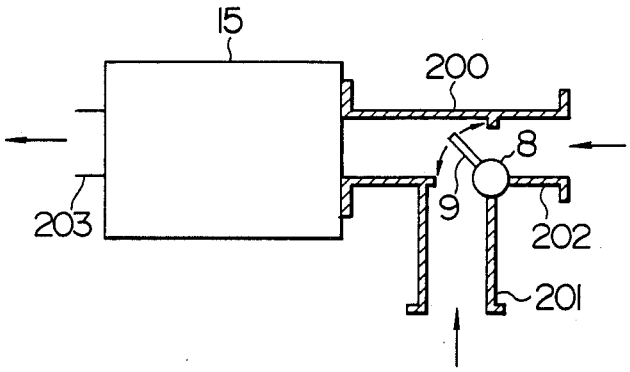
FIG. 6 is a cross-sectional view of a part of another example of the duct.

FIG. 6 shows another example of the duct structure. A duct unit 200 is constituted by a duct member forming a return air duct 201 and another duct member forming an outdoor air duct 202, these ducts intersecting each other at right angles. The duct unit 200 incorporates the damper 9 and the damper driving device 8.

The duct unit 200 can be fixed to the indoor unit 15 by being fastened by means of bolts or the like. It is possible to an additional duct to the end of each of the return air duct 201 and the outdoor air duct 202 so as to extend these ducts. This arrangement enables the installation working to be simplified because the duct unit is provided separately from the indoor unit.

Figure 7:
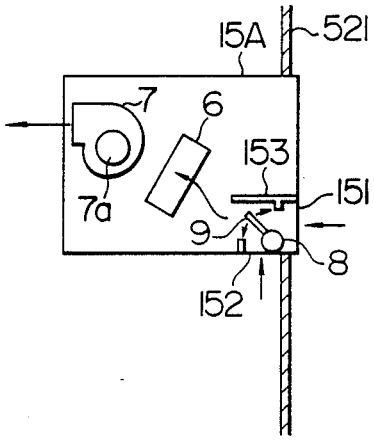
FIG. 7 is a side view of still another example of the duct.

FIG. 7 shows still another example of the duct structure. An outdoor air inlet 151 is opened in the back wall of an indoor unit 15A while a return air inlet 152 is opened in the bottom wall of the indoor unit 15A. The return air inlet 152 communicates with an air flow passage 153 formed in the indoor unit 15A. The damper 9 and the damper driving device 8 are disposed at the boundary between the inlets 151 and 152. In this arrangement, the duct structure is incorporated in the indoor unit 15A, thereby attaining a reduction in the overall size of the air conditioner.

In the above-described embodiment, the remote control panel is used, but the present invention is not limited to this. Instead, a control switch may be mounted in the outdoor or indoor unit.

The system in accordance with the present invention is an economizer which attain energy saving effects by automatically performing outdoor air introduction cooling.

The positional relationship between the indoor and outdoor units, the outdoor air duct and the return air duct may be modified in various ways so long as it does not deviate from the gist of the present invention.

For instance, the arrangement may be such that the indoor unit has only one air introduction passage in which the damper is disposed and which has branches formed as an outdoor air introduction passage and a return air passage.

In the above-described embodiment, there is no mention of the provision of an air filter in the air introduction passage. However, an air filter may be disposed in each of the outdoor air duct and the return air duct. Instead, an air filter may be disposed in front of the heat exchanger on the downstream of the damper.

The indoor unit may be mounted in such a manner that it passes through the wall of the room while an outdoor air introduction passage and a return air passage are separately manufactured and mounted. In this case, it is possible to improve the ease with which the air conditioner is installed by combining the damper parts into one integrated part.

As described above, the present invention makes it possible to automatically adjust the mixed air temperature to a suitable level in response to changes in the cooling load and the ventilation rate without requiring any manual operation of the user, thereby enabling a reduction in the rate of abrupt increase in the supplied air temperature when the cooling thermostat is switched off.

What is claimed is:

1. An air conditioner comprising:

an outdoor unit having a compressor a condenser and an expansion valve;

an indoor unit having an evaporator, piping connected to deliver air to a room and to receive exhausted room air and to receive outside air, and an indoor fan to control air delivery into a room;

duct means for receiving both outside air and exhausted room air thereby to provide mixed air;

a damper disposed in an air flow path to said indoor fan;

control apparatus having an input circuit connected to receive signals related to room air temperature, outside air temperature and mixed air temperature;

a memory circuit for storing a room temperature set point, a mixed air temperature initial set point, an outdoor-air-cooling-changeover outdoor air temperature set point, and a damper minimum opening set point; and an arithmetic processing section and a control circuit for controlling the operation of opening or closing said damper by comparing the room temperature with a room temperature set point, the outdoor air temperature with an outdoor-air-cooling-changeover outdoor air temperature set point, and the mixed air temperature with a mixed air temperature initial set point, by using an altered mixed air temperature set point higher than the mixed air temperature set point if a state in which the room temperature is lower than the room temperature set point has continued for a certain period of time, and by using another altered set point obtained by reducing the mixed air temperature set point if a state in which the room temperature is higher than the room temperature set point has continued for a certain period of time.

2. A method of operating an air conditioner comprising:

an outdoor unit having a compressor, a condenser, an expansion valve and an outdoor fan;

an indoor unit having an evaporator and an indoor fan;

piping arranged to deliver air to a room, to receive air exhausted from said room and to receive outdoor air which is mixed with said exhausted room air thereby to provide mixed air; and a room air temperature thermostat and a device for setting a mixed air temperature initial set point;

said method comprising the steps of:

operating said room temperature thermostat and said mixed air temperature device to maintain a desired room temperature utilizing a controlled flow of outdoor air;

altering the mixed air temperature set point to be higher than said initial set point during a period when the room temperature is lower than the room temperature set point and the air conditioner is in an "off" state; and reducing the mixed air temperature set point from said altered point that is higher than said initial set point in response to a continued state of operation during which the room temperature is higher than the room temperature set point.

* * * * *